United States Patent [19]

Miller

[11] 4,071,010

[45] Jan. 31, 1978

[54] ENGINE START-UP SYSTEM AND METHOD

[75] Inventor: Robert H. Miller, Peoria, Ill.

[73] Assignee: Caterpillar Tractor Co., Peoria, Ill.

[21] Appl. No.: 706,714

[22] Filed: July 19, 1976

[51] Int. Cl.[2] ..... F02M 63/02

[52] U.S. Cl. ..... 123/198 F; 123/139 AZ; 123/139 ST

[58] Field of Search ..... 123/198 F, 139 AZ, 139 ST, 123/179 L, 179 E, 139 B, DIG. 8; 417/212, 214, 216, 426

[56] References Cited

U.S. PATENT DOCUMENTS

| | | | |
|---|---|---|---|
| 3,240,197 | 3/1966 | Mock | 123/139 B |
| 3,319,568 | 5/1967 | Repko et al. | 417/270 |
| 3,741,685 | 6/1973 | Simko | 123/198 F X |
| 3,896,779 | 7/1975 | Omori et al. | 123/198 F X |
| 3,902,472 | 9/1975 | Baguelin | 123/198 F X |
| 3,976,042 | 8/1976 | Baguelin | 123/139 ST |

*Primary Examiner*—Charles J. Myhre
*Assistant Examiner*—Ira S. Lazarus
*Attorney, Agent, or Firm*—Phillips, Moore, Weissenberger, Lempio & Majestic

[57] ABSTRACT

An internal combustion engine comprises first and second banks of fuel injection means each adapted to communicate fuel to a combustion chamber of the engine in response to rotation of an engine-driven cam shaft. Upon start-up of the engine, a handle-actuated lock-out mechanism is actuated to inactivate one of the banks of fuel injection means whereby fuel communicates only through the other one of the banks of fuel injection means. After engine warm-up, the handle of the lock out mechanism is released to permit normal engine operation whereby fuel communicates through both of the banks of fuel injection means.

22 Claims, 8 Drawing Figures

VIII
VI
VII
10
11
12
13
14
15
16
17
18
19
20
21
22
23
24
25
26
27
28
29
30
31
32
33
34
35
36
37
39
40
41
42
43
44

ENGINE START-UP SYSTEM AND METHOD

BACKGROUND OF THE INVENTION

During start-up of a conventional eight cylinder diesel engine, a charge of fuel is injected into each combustion chamber thereof and ignited due to the heat of compression. Fuel is alternately injected into each combustion chamber by a pump of a conventional sleeve metering fuel system having a plunger which reciprocates in response to rotation of an engine-driven cam shaft.

Until the engine warms up, operation of all eight cylinders gives rise to a "white smoke" condition of engine operation. Such condition occurs during cold start-up since engine exhaust contains an overabundant amount of irritants, such as hydrocarbons, aldehydes and oxides of nitrogen. This condition is primarily occasioned by the cold air which provides a disproportionate air-fuel mixture which normally approximates 15:1 to 22:1 upon warm-up of the engine.

SUMMARY OF THIS INVENTION

An object of this invention is to overcome the abovementioned "white smoke" condition of engine operation by providing a lock-out means whereby one bank of fuel injection means, such as cam-actuated fuel pumps, can be inactivated upon start-up of the engine. Upon warm-up of the engine, the lock-out means may be released to return the engine to its normal condition of operation wherein both banks of the fuel injection means are rendered operative to thus permit firing of all of the engine's cylinders.

In the preferred embodiment of this invention, the engine constitutes a diesel with each fuel injection means being a cam-actuated fuel pump of a sleeve metering fuel system, having a plunger thereof reciprocally mounted therein. A pair of axially spaced fill and spill ports are formed in the plunger and a sleeve is reciprocally mounted thereon to alternately cover and uncover the spill port. A handle, mounted externally on the engine, is adapted to be actuated by the operator upon engine start-up to lock-out the fuel pumps for one bank of the cylinders and to thereafter permit firing of all of the cylinders upon release of the handle.

BRIEF DESCRIPTION OF THE DRAWINGS

Other objects of this invention will become apparent from the following description and accompanying drawings wherein.

DETAILED DESCRIPTION

Figures 1, 2, 3, 4:
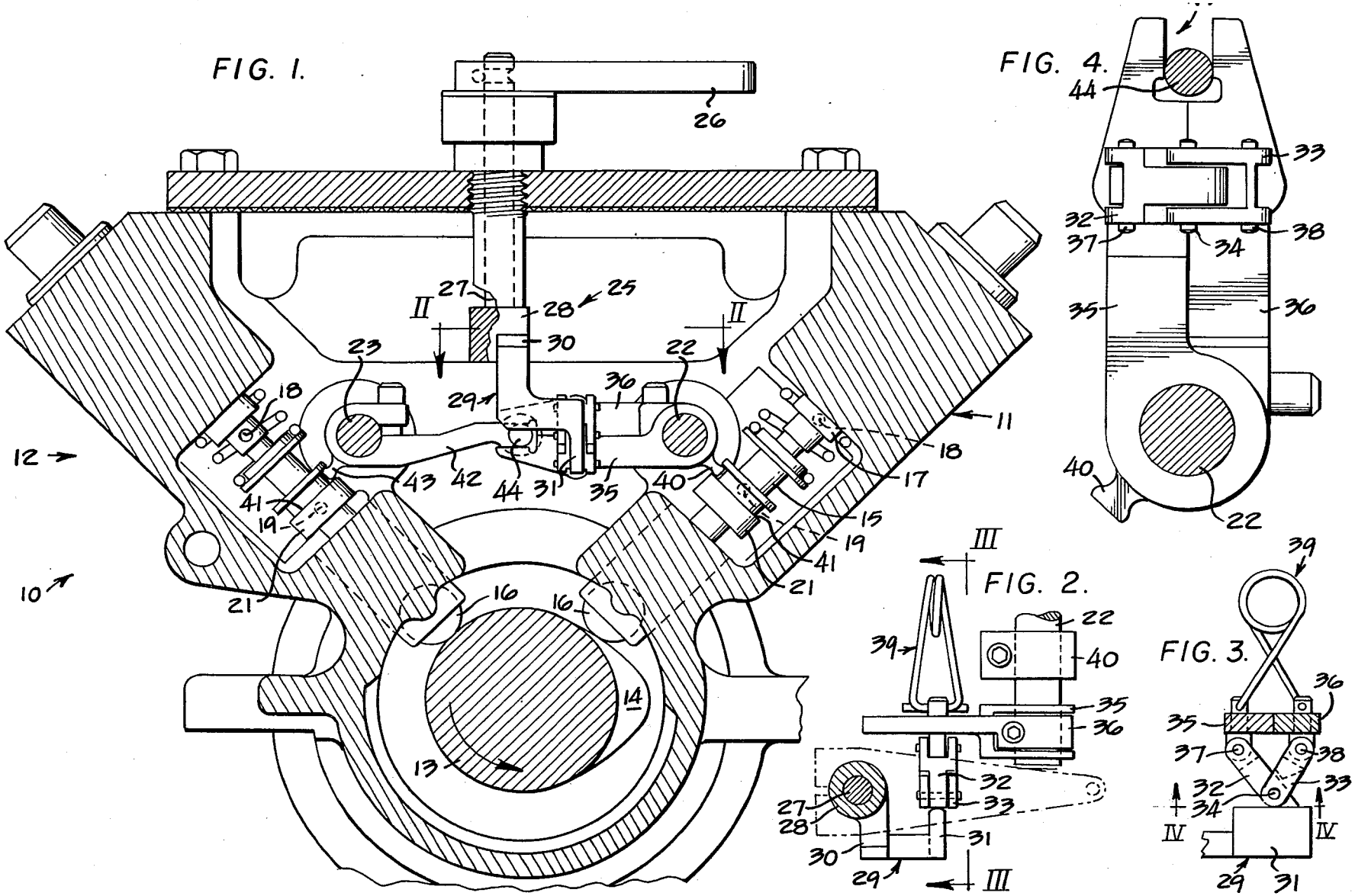
FIG. 1 is a cross sectional view of a sleeve metering fuel system for a diesel engine comprising two banks of fuel pumps therein, both conditioned for operation.
FIG. 2 is a view taken in the direction of arrows II–II in FIG. 1 to illustrate a portion of a lock-out means employed in the system to selectively lock-out one bank of fuel pumps.
FIG. 3 is a view taken in the direction of arrows III—III in FIG. 2.
FIG. 4 is an enlarged view taken in the direction of arrows IV—IV in FIG. 3.
Figures 5, 6, 7, 8:
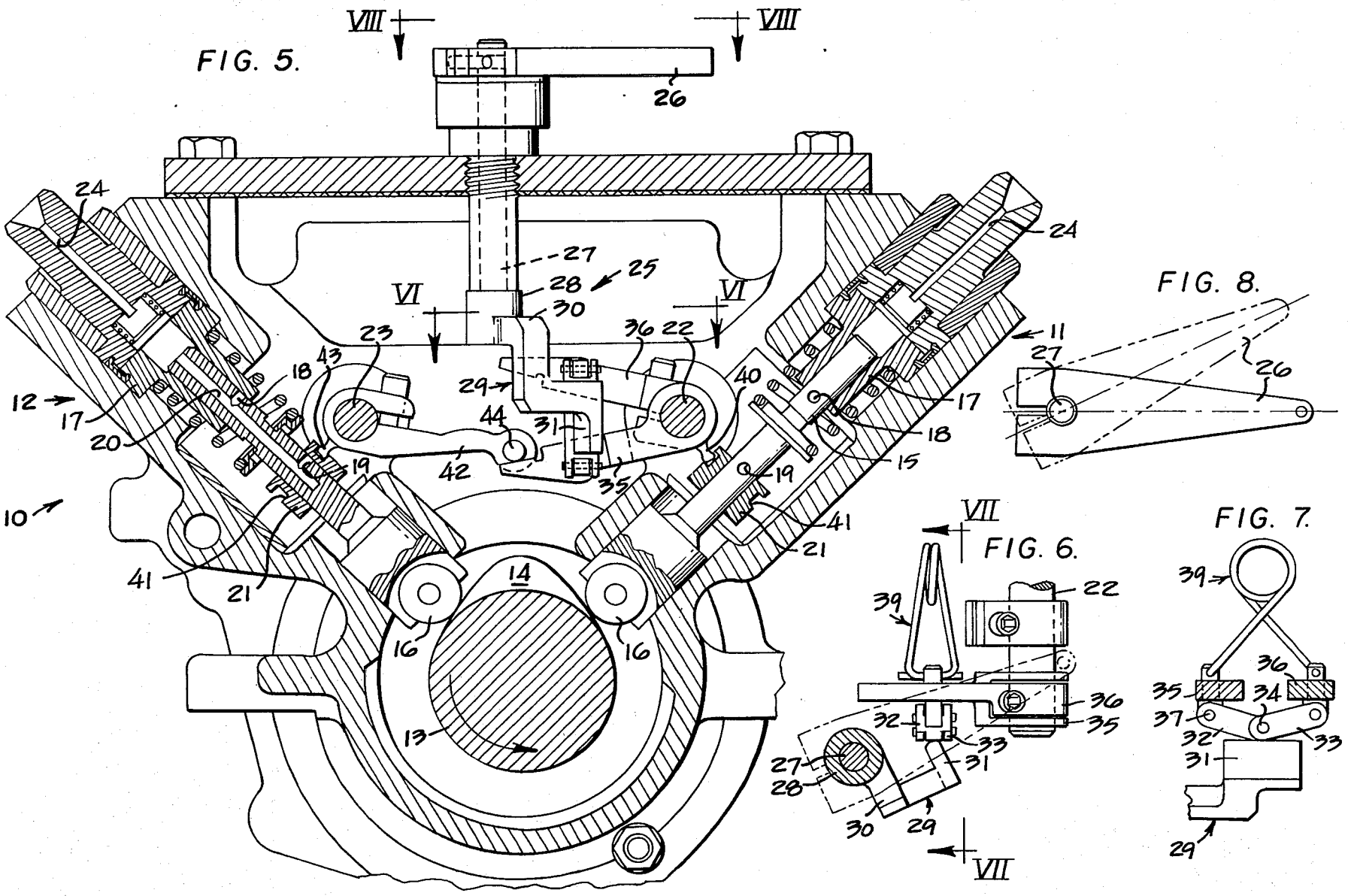
FIG. 5 is a view similar to FIG. 1, but showing the sleeve metering fuel system sectioned in greater detail and illustrating the lock-out means in a condition of operation wherein one bank of fuel pumps is inactivated.
FIG. 6 is a view taken in the direction of arrows VI—VI in FIG. 5.
FIG. 7 is a view taken in the direction of arrows VII—VII in FIG. 6.
FIG. 8 is a view taken in the direction of arrows VIII—VIII in FIG. 5, to illustrate two rotative positions of a handle employed to actuate the lock-out means of this invention.

FIGS. 1 and 5 illustrate a sleeve metering fuel system 10 for an internal combustion diesel engine comprising first and second banks of fuel injection means or pumps 11 and 12, respectively. The engine may be of four, six or eight cylinder type wherein a single pump is adapted to communicate pressurized fuel to the combustion or precombustion chamber of a respective cylinder thereof (not shown). An engine driven cam shaft 13 has a cam lobe 14 secured thereon to reciprocate a plunger 15 of each pump via a follower 16 mounted on a lower end thereof.

Each pump further comprises a barrel 17 having an upper end of the plunger reciprocally mounted therein. A pair of axially spaced fill and spill ports 18 and 19, respectively, are formed in the plunger and communicate with each other via an axial passage 20. A sleeve 21 is reciprocally mounted on a lower end of the plunger to alternately cover and uncover spill port 19, as will be hereinafter more fully explained.

A pair of slave and master control shafts 22 and 23, respectively, are rockably mounted in a housing of the fuel system to selectively move a respective sleeve 21 for alternately covering and uncovering the spill port. In normal operation with pumps 11 and 12 conditioned as illustrated in FIG. 1, master control shaft 23 may be rocked in a conventional manner under control of the operator's throttle or accelerator pedal (not shown) to also rock slave control shaft 22. Such ac-tuation of the rock shafts to selectively reciprocate sleeves 21 of pumps 11 and 12 is effected by conventional linkage, more fully disclosed in U.S. Pat. Nos. 3,385,221 and 3,472,215, both assigned to the assignee of this application.

As also described in such patents, normal engine operation with the pumps being conditioned as shown in FIG. 1 will be as follows. The housing of the fuel system is at least substantially filled with liquid diesel fuel and plunger 15 is thus surrounded thereby. Thus, upon rotation of cam shaft 13 spring-biased plunger 15 will reciprocate and when fill port 18 moves below the bottom edge of barrel 17 passage 20 will fill with diesel fuel from this pressurized reservoir. The inrushing flow of fuel into the fill port on the downward movement of the plunger will thus charge the pump with fuel.

At the properly timed moment, as dictated by cam lobe 14, the plunger will move upwardly to close the fill port as it passes into barrel 17. Since spill port 19 is covered by sleeve 21, upward movement of the plunger will eject pressurized fuel through a passage 24 to begin injection of the fuel into the combustion chamber of a respective cylinder of the engine. Ejection will continue as long as the fill and spill ports are completely blocked by the barrel and by the sleeve.

The injection phase of engine operation will terminate the moment the spill port edges above the sleeve to thereby release the pressure in passage 20. The fuel thus escapes from the pump and is dumped back into the reservoir defined in the housing of the fuel system. As suggested above, rock shaft 23 may be actuated in a conventional manner to increase the amount of fuel injected by positioning each sleeve 21 higher on a plunger to maintain spill port 19 closed for a longer period of time.

This invention is drawn to a lock-out means, generally shown at 25, which functions to selectively communicate fuel through only bank of pumps 12 while simultaneously inactivating the bank of pumps 11. Such lock-out function is accomplished by moving sleeve 21 of each pump 11 downwardly on plunger 15 to continuously expose spill port 19 upon engine start-up. As mentioned above, the inactivation of one bank of pumps substantially decreases the amounts of irritants, such as hydrocarbons, aldehydes and oxides of nitrogen, exhausted to ambient by the engine upon cold start-up. In particular, normal operation of a diesel engine requires fifteen to twenty-two parts of air to one part of fuel. When the air is cold, it tends to contract to provide a disproportionate air-to-fuel mixture which, in turn, promotes an excessive production of irritants in the engine exhaust.

The lock-out means comprises a handle 26 rotatably mounted on a cover plate secured on the housing of the fuel system. The handle has the upper end of a vertically disposed shaft 27 secured thereto with a lower end and 36 the shaft having a collar 28 secured thereon. spring means, camming member 29 has an upper end 30 secured to collar 28 and has an offset lower end 31 disposed in camming relationship adjacent to first ends of a pair of links 32 and 33.

As more clearly shown in FIGS. 3 and 4, the first ends of the links are pivotally connected together by a pin 34 whereas the second end of the links are pivotally connected to a pair of levers 35 and36 by pivot pins 37 and 38, respectively. A spring means, preferably comprising a torsion spring 39, has its free ends anchored to the first ends of the levers, adjacent to pivot pins 37 and 38. It can thus be seen in FIGS. 2 and 3 that the spring will function to bias the scissor-like levers towards a closed or collapsed position.

An end of lever 36 is firmly clamped to shaft 22 to normally oscillate therewith. The adjacent end of lever 35, however, is "loosely" mounted on the shaft whereby pivotal movements of the lever will not effect rotational displacement of the shaft and vice versa. Lever 36 has a plurality of sleeve control levers 40 secured thereon and disposed to engage an annular groove 41 formed on the periphery of sleeve 21 to reciprocate the sleeve upon rotational movement of the lever and shaft 22.

A third lever 42 is clamped in secured relationship on rock shaft 23 and also has a control lever 43 secured thereon which engages annular groove 41 formed on sleeve 21 of second pump 12. Thus, in the operating position illustrated in FIG. 1 the operator's actuation of the throttle or accelerator pedal (not shown) will, in turn, rock master control shaft 23 clockwise. A second end of lever 42 has a pin 44 secured thereon which is trapped in a lost motion slot, generally indicated at 45 in FIG. 4, to thus pivot clamped-together levers 35 and 36 and slave control shaft 22 counterclockwise in FIG. 1. Therefore, sleeves 41 of both the first and second pumps 11 and 12 may be moved upwardly on the respective plungers to keep spill ports 19 closed for a longer period of time to increase the amount of fuel injected into the combustion chambers of the engine's cylinders.

Upon start-up of the engine, handle 26 is rotated from its solid line to its phantom-line position illustrated in FIG. 8. Cam portion 31 of member 29 is thus moved against the coupled ends of links 32 and 33 to separate the levers, as illustrated in FIGS. 5–7. Simultaneously therewith, control lever 40, secured to lever 36 and shaft 22, will move sleeve 21 downwardly on plunger 15 to uncover spill port 19. It should be noted that master control shaft 23 may be rocked by the operator to move sleeve 21 of second pump 12 but will not move sleeve 21 of pump 11, i.e., lever 35 freely rotates on shaft 22.

After the engine has warmed up, the operator will then release handle 26 to permit it to move back to its solid line position illustrated in FIG. 8. Lock-out means 25 will then reassume its position illustrated in FIG. 1 wherein normal engine operation ensues with both banks of the pumps and the cylinders receiving fuel therefrom being rendered operative. Spring 39 will function to collapse levers 35 and 36 upon release of the handle by the operator.

I claim:

1. In combination with an internal combustion engine comprising a sleeve metering fuel system including first and second banks of pumps, a housing at least substantially filled with liquid diesel fuel, a cam shaft rotatably mounted in said housing, a master control shaft rockably mounted in said housing and a plurality of control levers secured on said master control shaft, each of said pumps comprising a plunger reciprocally mounted in said housing and engageable with said cam shaft for reciprocation thereby, a pair of axially spaced fill and spill ports formed in said plunger, a barrel mounted in said housing and having an upper end of said plunger reciprocally mounted therein and positioned to alternately cover and uncover said fill port upon reciprocation of said plunger and a sleeve reciprocally mounted on a lower end of said plunger for alternately covering and uncovering said spill port, each of said control levers engaged with the sleeve of each pump of said second bank of pumps, lock-out means for selectively permitting (1) communication of fuel through only said second bank of pumps, or (2) communication of fuel through each of said first and second banks of pumps.

2. The combination of claim 1 wherein said engine is of the diesel-type.

3. The combination of claim 1 wherein said sleeve metering fuel system further comprises a slave control shaft rockably mounted in said housing, a plurality of control levers secured on said slave control shaft and each engaged with the sleeve of each pump of said first bank of fuel injection means and wherein said master control shaft is connected to said slave control shaft by said lock-out means for rocking said slave control shaft in response to rocking movements of said master control shaft when said lock-out means selectively permits communication of fuel through each fuel injection means of both said first and second banks of fuel injection means.

4. The combination of claim 3 wherein said lock-out means comprises a first lever secured to said slave control shaft, a second lever rotatably mounted on said slave control shaft and spring means connected between said first and second levers for normally biasing said levers towards each other.

5. The combination of claim 4 wherein said lock-out means further comprises a third lever secured on said master control shaft and a pin secured on a free end of said third lever and disposed in a lost motion slot defined in opposed free ends of said first and second levers when said first and second levers are disposed adjacent to each other under the biasing force of said spring means.

6. The combination of claim 5 wherein said lock-out means further comprises a pair of links having first ends thereof pivotally connected together and wherein a second end of each of said links is pivotally connected to a respective one of said first and second levers.

7. The combination of claim 6 wherein said lock-out means further comprises a handle rotatably mounted exteriorly on the housing of said sleeve metering fuel system, a shaft having its upper end secured to said handle and an actuating member having a first end secured to said shaft and a second end disposed adjacent to the connected first ends of said pair of links to selectively apply a force thereagainst to spread said first and second levers against the biasing force of said spring means upon rotation of said handle.

8. In combination with an internal combustion engine comprising first and second banks of fuel injection means, lock-out means for selectively permitting (1) communication of fuel through only said second bank of fuel injection means, or (2) communication of fuel through each of said first and second banks of fuel injection means, said lock-out means comprising control means adapted to be moved between first and second positions and linkage means interconnected between said control means and said first bank of fuel injection means for selectively permitting condition (1) or (2), above, in response to movement of said control means between said first and second positions thereof, said linkage means comprising a pair of scissor-like first and second levers, said first lever having a first end thereof rotatably mounted on a rock shaft and a first end of said second lever being secured on said rock shaft for oscillation therewith.

9. The combination of claim 8 wherein said linkage means further comprises a rotatable shaft having an upper end thereof secured to said control means and a camming member secured to a lower end of said shaft.

10. The combination of claim 9 wherein said linkage means further comprises a pair of links having first ends thereof pivotally connected together and disposed adjacent to said camming member for having a force applied thereto by said camming member upon rotation of said rotatable shaft and wherein a second end of each of said links is pivotally connected to a respective one of said first and second levers.

11. The combination of claim 10 wherein said engine is of the diesel-type and each of said fuel injection means comprises a pump of a sleeve metering fuel system.

12. The combination of claim 11 wherein each of said pumps comprises a cam-actuated plunger reciprocally mounted therein, a pair of axially spaced fill and spill ports formed in said plunger and a sleeve reciprocally mounted on said plunger for selectively covering and uncovering said spill port.

13. The combination of claim 12 wherein said sleeve metering fuel system further comprises a master control shaft rockably mounted in a housing thereof which is at least substantially filled with liquid diesel fuel and a plurality of control levers secured on said master control shaft, each of said levers engaged with the sleeve of each pump of said second bank of fuel injection means.

14. The combination of claim 13 wherein said rock shaft constitutes a slave control shaft rockably mounted in said housing, a plurality of control levers secured on said slave control shaft and each engaged with the sleeve of each pump of said first bank of fuel injection means and wherein said master control shaft is connected to said slave control shaft by the first and second levers of said lock-out means for rocking said slave control shaft in response to rocking movements of said master control shaft when said lock-out means selectively permits communication of fuel through each fuel injection means of both said first and second banks of fuel injection means.

15. The combination of claim 14 wherein said second lever is secured to said slave control shaft, said first lever is rotatably mounted on said slave control shaft and further comprising spring means connected between said first and second levers for normally biasing said levers towards each other.

16. The combination of claim 15 wherein said lock-out means further comprises a third lever secured on said master control shaft and a pin secured on a free end of said third lever and disposed in a lost motion slot defined in opposed free ends of said first and second levers when said first and second levers are disposed adjacent to each other under the biasing force of said spring means.

17. A method for starting an engine having first and second banks of fuel injection means each having a plunger reciprocally mounted therein comprising the steps of starting said engine while simultaneously first communicating fuel through only said first bank of fuel injection means while simultaneously spilling fuel from said second bank of fuel injection means without stopping reciprocation of the plungers thereof and thereafter second communicating fuel through both said first and second banks of fuel injection means upon warm-up of said engine.

18. The method of claim 17 wherein said first and second communicating steps comprise communicating liquid diesel fuel through pumps of a sleeve metering fuel system, constituting said fuel injection means.

19. The method of claim 18 wherein said first communicating step comprises moving a sleeve of each pump of said first bank of fuel ejection means to uncover a spill port formed in a respective plunger thereof.

20. The method of claim 17 wherein said first communicating step comprises moving a handle from a first to a second position thereof.

21. The method of claim 20 wherein said second communicating step comprises releasing said handle to permit it to return to its first position.

22. In combination with an internal combustion engine comprising first and second separate banks of fuel injection means each having a plunger reciprocally mounted therein and a pair of fill and spill ports formed in said plunger, lock-out means for selectively permitting (1) communication of fuel through only said second bank of fuel injection means while simultaneously spilling fuel from the spill ports of the plungers of said first bank of fuel injection means without stopping reciprocation of such plungers, or (2) communication of fuel through each of said first and second banks of fuel injection means.

* * * * *